US006491553B2

(12) United States Patent
Northey

(10) Patent No.: US 6,491,553 B2
(45) Date of Patent: Dec. 10, 2002

(54) ELECTRICAL CONNECTOR HAVING AN ELECTRICAL CONTACT WITH A FORMED SOLDER CUP

(75) Inventor: William A. Northey, Etters, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/742,935

(22) Filed: Dec. 20, 2000

(65) Prior Publication Data

US 2002/0077003 A1 Jun. 20, 2002

(51) Int. Cl.[7] ..... H01R 4/02
(52) U.S. Cl. ..... 439/874
(58) Field of Search ..... 439/874, 857, 439/855, 856

(56) References Cited

U.S. PATENT DOCUMENTS

| | | | | | |
|---|---|---|---|---|---|
| 1,899,254 | A | * | 2/1933 | Bear | 439/865 |
| 2,462,867 | A | * | 3/1949 | Hubbell | 439/874 |
| 2,800,637 | A | * | 7/1957 | Nicolaus | 439/874 |
| 3,523,173 | A | * | 8/1970 | Lull | 174/84 C |
| 3,706,960 | A | * | 12/1972 | Grenda | 439/855 |
| 3,771,111 | A | * | 11/1973 | Pritulsky | 439/850 |
| 3,838,387 | A | * | 9/1974 | Grillet | 174/71 R |
| 3,947,083 | A | * | 3/1976 | Ahmed et al. | 439/855 |
| 4,196,960 | A | * | 4/1980 | Gelfand | 439/874 |
| 4,466,681 | A | * | 8/1984 | Meindl | 439/395 |
| 4,546,542 | A | * | 10/1985 | Proud | 29/564.6 |
| 4,553,809 | A | * | 11/1985 | Holt | 174/84 R |
| 4,556,276 | A | * | 12/1985 | Curtis, III | 439/862 |
| 4,606,599 | A | | 8/1986 | Grant et al. | 339/258 |
| 4,692,121 | A | * | 9/1987 | Arbogast, Jr. | 29/874 |
| 4,717,354 | A | | 1/1988 | McCleerey | 439/444 |
| 4,743,208 | A | * | 5/1988 | Weisenburger | 439/398 |
| 4,818,058 | A | | 4/1989 | Bonanni | 350/96.2 |
| 4,889,506 | A | | 12/1989 | Connolly et al. | 174/874 |
| 4,943,248 | A | * | 7/1990 | Colleran et al. | 439/621 |
| 5,024,610 | A | * | 6/1991 | French et al. | 439/857 |
| 5,222,811 | A | * | 6/1993 | Miyoshi | 174/94 R |
| 5,290,970 | A | | 3/1994 | Currie | 174/250 |
| 5,357,074 | A | * | 10/1994 | Pawlikowski | 219/553 |
| 5,498,180 | A | | 3/1996 | Krantz et al. | 439/851 |
| 5,554,056 | A | * | 9/1996 | Henricus op ten Berg | 439/851 |
| 5,586,912 | A | | 12/1996 | Eslampour et al. | 439/620 |
| 5,634,830 | A | * | 6/1997 | Weingartner | 439/857 |
| 5,725,400 | A | * | 3/1998 | Morikawa et al. | 174/74 R |
| 5,730,629 | A | * | 3/1998 | Samejima et al. | 29/874 |
| 5,743,754 | A | | 4/1998 | Cristich | 439/349 |
| 5,827,094 | A | * | 10/1998 | Aizawa et al. | 439/857 |
| 5,980,337 | A | * | 11/1999 | Little | 439/857 |
| 6,000,975 | A | * | 12/1999 | Feldman | 439/857 |
| 6,171,126 | B1 | * | 1/2001 | Wu et al. | 439/224 |
| 6,280,216 | B1 | * | 8/2001 | Bernier et al. | 439/251 |

* cited by examiner

*Primary Examiner*—Tho D. Ta
*Assistant Examiner*—Edwin A. León
(74) *Attorney, Agent, or Firm*—Harrington & Smith, LLP

(57) ABSTRACT

An electrical contact having a formed one-piece member. The formed one-piece member includes a first connection section adapted to make a removable connection with a mating contact; and a second connection section having a receiving area adapted to have a conductor positioned in the receiving area and fixed to the second connection section by a solder material positioned into the receiving area. The receiving area of the second section includes a center longitudinal axis which is angled relative to a longitudinal connection axis of the first section.

8 Claims, 4 Drawing Sheets

ELECTRICAL CONNECTOR HAVING AN ELECTRICAL CONTACT WITH A FORMED SOLDER CUP

BACKGROUND OF THE INVENTION

1. Field of the Invention

The present invention relates to electrical connectors and, more particularly, to an electrical connector having an electrical contact with a formed solder cup.

2. Brief Description Of Earlier Developments

U.S. Pat. No. 4,717,354 discloses an electrical connector having an electrical contact with a solder cup. The solder cup has a longitudinal axis which is parallel or coaxial with the longitudinal axis of the contact. There is a desire to reduce the length of contacts in some types of connectors, but still provide a solder cup connection for wires to be connected to the contacts. There is also a desire to provide right angle termination of wires to some connectors and a desire to provide a connector system to keep wire exit from a connector in a low profile off of the back of the connector. However, a further desire is to manufacture contacts from one-piece members to keep manufacturing cost low.

SUMMARY OF THE INVENTION

An electrical contact having a formed one-piece member. The formed one-piece member comprises a first connection section adapted to make a removable connection with a mating contact; and a second connection section having a receiving area adapted to have a conductor positioned in the receiving area and fixed to the second connection section by a solder material positioned into the receiving area. The receiving area of the second section comprises a center longitudinal axis which is angled relative to a longitudinal connection axis of the first section.

An electrical contact having a formed one piece member. The formed one-piece member comprises a first connection section adapted to make a removable connection with a mating contact; and a second connection section forming a solder cup for receiving a conductor and solder to fixedly connect the conductor to the contact. The one-piece member comprises two plate sections folded generally parallel to each other. The end sections of each plate section are folded in an inward direction, each at a different length along the plate sections, to form the solder cup between the end sections.

A method of manufacturing an electrical contact comprising steps of providing a substantially flat one-piece member having two plate sections; deforming the one-piece member to locate the two plate sections substantially parallel to each other; and forming ends of the two plate sections in respective generally opposite inward directions, at different respective lengths along the plate sections, to form a solder receiving area between the ends.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1A:
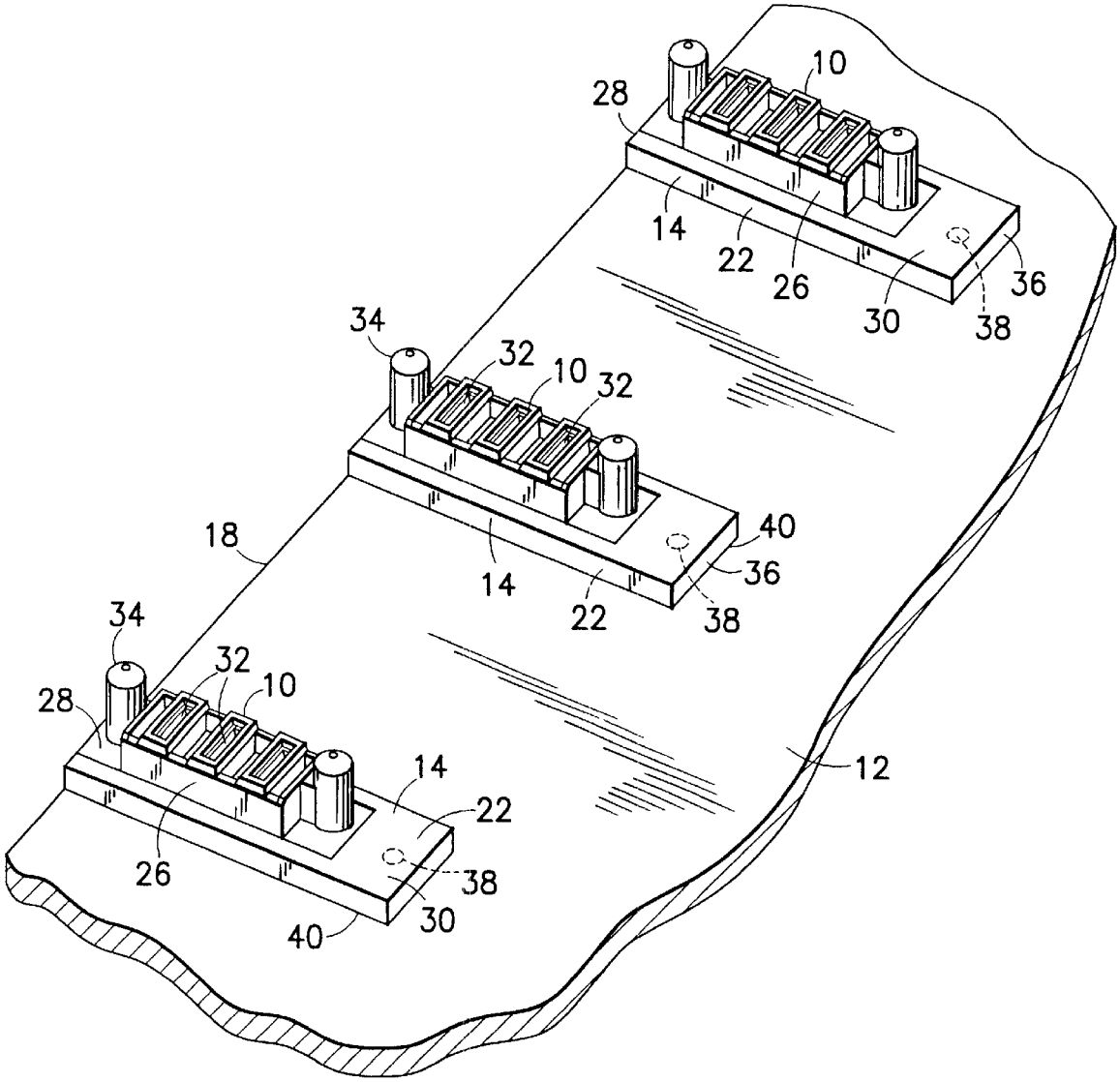
FIG. 1A is a perspective view of a portion of a support member and three electrical connectors incorporating features of the present invention.

Referring to FIG. 1A, there is shown a perspective view of three electrical connectors 10 incorporating features of the present invention shown attached to a support member 12. Although the present invention will be described with reference to the single embodiment shown in the drawings, it should be understood that the present invention can be embodied in many alternate forms of embodiments. In addition, any suitable size, shape or type of elements or materials could be used.

Figure 1B:
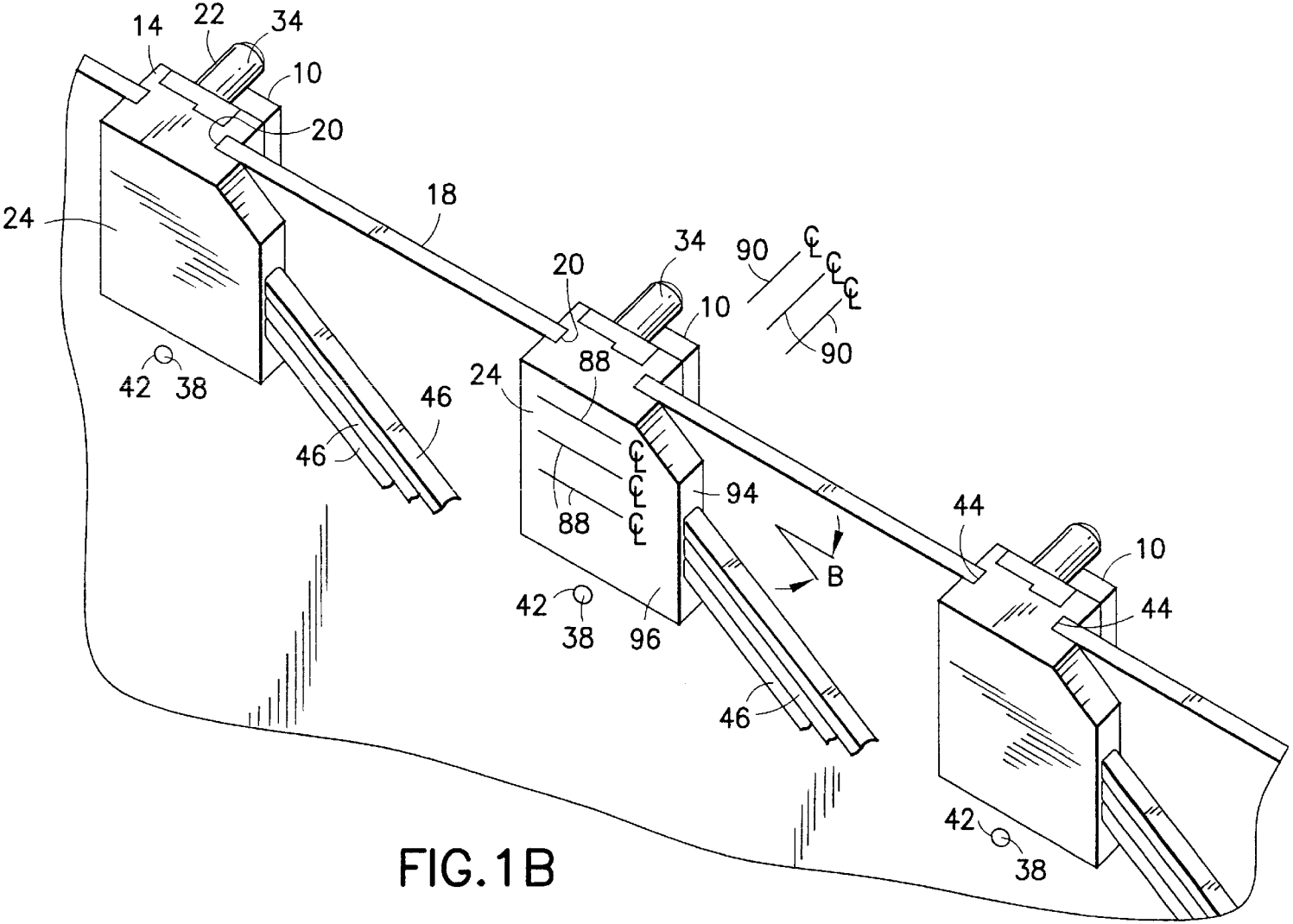
FIG. 1B is a perspective view of the opposite side of the assembly shown in FIG. 1A.
Figure 2:
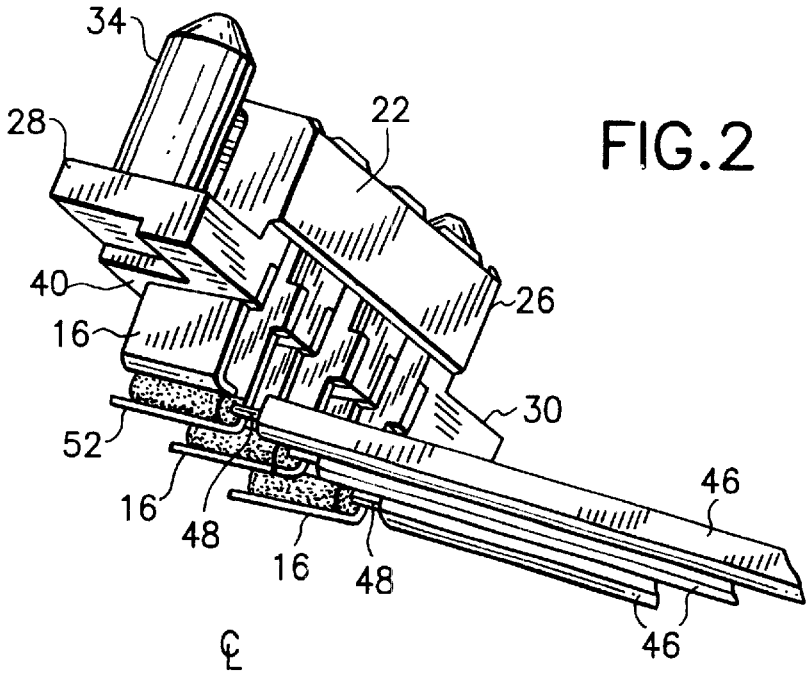
FIG. 2 is a perspective view of one of the connectors shown in FIGS. 1A and 1B before the second housing member is attached.

Referring also to FIGS. 1B and 2, each of the connectors 10 generally comprises a housing 14 and electrical contacts 16. Although three connectors 10 are shown, the connectors 10 can be provided singularly and/or with other electrical connectors. In this embodiment the support member 12 is a printed circuit board. However, in alternate embodiments the support member 12 could be any suitable type of member, and the connector(s) 10 can be adapted to be connected to any other suitable member. In the embodiment shown the connectors 10 are attached to the support member 12 at an edge 18. More specifically, the support member 12 has slots or apertures 20 which extend inward from the edge 18. The connectors 10 are located in the slots 20. However, in an alternate embodiment, the apertures 20 might not be present at all (i.e.: the connector 10 could be mounted on only one side of support member 12) or the apertures 20 might not extend from an edge.

The housing 14 generally comprises a first housing member 22 and a second housing member 24. However, in alternate embodiments the housing 14 could comprise more or less than two housing members. The first housing member 22 is preferably comprised of molded plastic or polymer material. However, any suitable material(s) could be used. In this embodiment, the first housing member 22 generally comprises a contact receiving section 26 and two end sections 28, 30. The contact receiving section 26 generally comprises contact receiving areas 32 which are adapted to receive front ends of the contacts 16. The first end section 28 has a post 34 which extends from the front side of the housing for making a connection with a mating electrical connector (not shown). The opposite second end section 30 also has a post 34 which extends from the front side. In addition, the second end section 30 has an extension 36 with a mounting projection 38 extending from its rear side 40. As seen in FIG. 1B, the member 12 has apertures 42 which receive the projections 38. The housing 14 has side slots 44 on opposite lateral sides. The housings 14 are slid into the apertures 20 with portions of the member 12 being received in the slots 44. The projections 38 then snap-lock into the apertures 42 to fixedly attach the housings 14 to the member 12. However, in alternate embodiments any suitable means could be used to attach the connectors to the member 12. Thus, the slots 44, extension 36 and projections 38 might not be provided. In another alternate embodiment, the first housing member 22 might not have the posts 34.

In this embodiment the second housing member 24 is comprised of plastic or polymer material that is over-molded onto the first housing member 22 and rear ends of the contacts 16. However, in alternate embodiments the second housing member 24 could be comprised of any suitable material(s) and could be formed by any suitable process including, for example, pre-molding the second housing member and then attaching it to the first housing member by any suitable attachment means. As seen in FIG. 2, wires 46 having electrical conductors 48 are connected to the rear ends of the contacts 16. The second housing member 24 is molded over the connection of the conductors 48 to the contacts 16 to form a strain relief and an electrical insulation.

Figure 3:
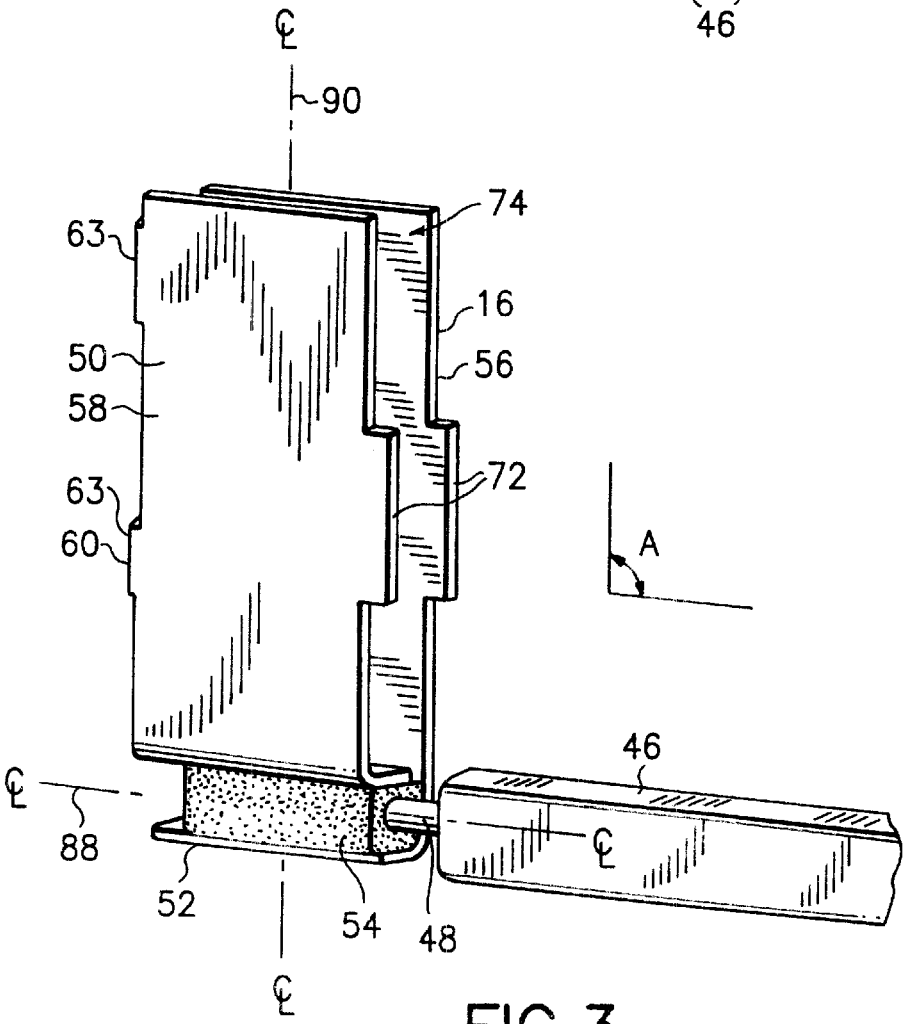
FIG. 3 is a perspective view of one of the contacts of the connector shown in FIG. 2 and the respective wire attached to that contact.
Figure 4:
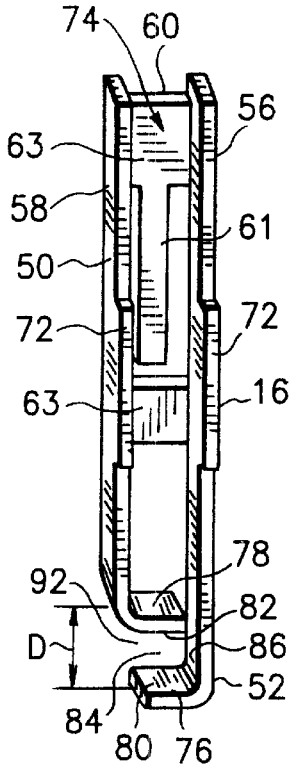
FIG. 4 is a bottom perspective view of the contact shown in FIG. 3 before wire attachment.
Figure 5:
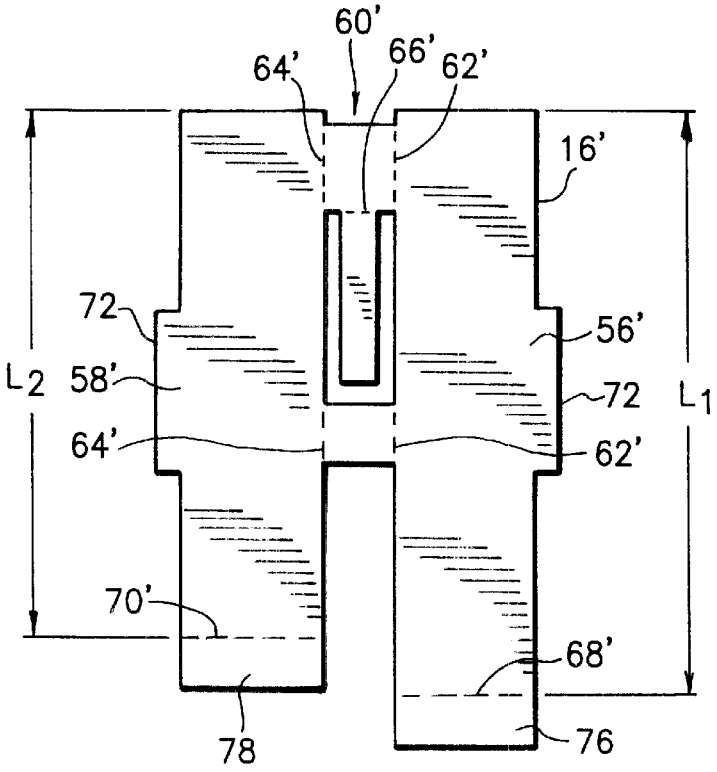
FIG. 5 is a top plane view of a flat blank used to make the contact shown in FIG. 4.

Referring also to FIGS. 3, 4 and 5, each contact 16 generally comprises a first connection section 50 and a second connection section 52. In this embodiment each connector 10 has three of the contacts 16. However, more or less than three of the contacts 16 could be provided and the connector could have additional different types of contacts. The first connection section 50 could be a female connection section adapted to make a removable electrical connection with a male terminal in the mating electrical connector (not shown). However, the first section 50 could be a male connection section or any other suitable connection shape. The second connection section 52 is adapted to be fixedly connected to one of the conductors 48 of the wires 46, such as by solder 54. The contact 16 is preferably comprised of a one-piece member which is formed into the contact. In a preferred embodiment, the one-piece member is a flat metal member or blank 16' as shown in FIG. 5 which has been formed, such as by stamping, from a sheet of flat stock material. However, any suitable method could be used to form the blank 16'. The blank 16' in this embodiment comprises two side sections 56', 58' and a middle section 60'. The blank 16' is formed or bent at locations 62', 64', 66', 68' and 70' to form the contact 16 as shown in FIG. 4. After the blank 16' is bent at locations 62' and 64', the middle section 60' forms a top section 60 of the contact 16 with an upwardly extending deflectable mounting latch 61. The side sections 56', 58' form sides 56, 58 of the contact 16 which are generally parallel to each other and form a female contact receiving area 74 therebetween. The sides 56, 58 form substantially parallel and spaced planar plate sections forming the contact receiving area 74 therebetween. The top section 60 also has sections 63 that connect the side sections 56, 58 to each other. In addition, after the blank 16' is bent at locations 62' and 64', feet 72 of the side sections 56, 58 are located at the bottom of the contact. The first connection section 50 is formed by the top section 60 and the side sections 56, 58. The latch 61 and the feet 72 cooperate with the first housing member 22 to mount the contact 16 to the first housing member 22 with the first connection section 50 in the contact receiving areas 32 of the contact receiving section 26. However, any suitable means could be used to attach the contacts to the first housing member. In this embodiment the connector 10 is a power connector adapted to supply electrical power between the wires 46 and the mating connector (not shown). Thus, the contacts 16 could be AC or DC power contacts adapted to conduct electrical power, such as for example, 240 Volts and 15 Amps AC current, or 48 Volts and 30 Amps DC current. The first connection section 50 could be similar to the contacts disclosed in U.S. patent application Ser. Nos. 09/160,900 and 09/697,959 which are hereby incorporated by reference in their entireties.

The second connection section 52 of each contact 16 is formed by the rear ends 76, 78 of the two side sections 56, 58. More specifically, the rear ends 76, 78 are bent in opposite inward directions at locations 68', 70'. Locations 68' and 70' are located at different lengths $L_1$ and $L_2$ along the side sections 56, 58. Thus, the ends 76, 78 are offset from each other by a distance D. The inside surface 80 of the outer end 76 faces the outside surface 82 of the inner end 78. This forms an area 84 bounded by surfaces 80, 82 and surface 86 of the inner side of the first side section 56 which can function as a receiving area for the end of one of the conductors 48 and solder 54. The second connection section 52, thus, has a general cross-sectional "U" shape with the ends forming substantially parallel legs of the general "U" shape; although the end 78 does not need to contact the side 56. This forms the second connection section as a solder cup. However, in an alternate embodiment the second connection section could be adapted to be crimped to the conductor, or any suitable direct connection could be provided by the second connection section. The area 84 has a longitudinal centerline axis 88 which is angled relative to the longitudinal connection axis 90 of the first section 50. In a preferred embodiment the angle is about 90°. However, in alternate embodiments, any suitable angle could be provided. In alternate embodiments the ends 76, 78 could be formed into any suitable shape(s) so long as they form a receiving area for the conductor 48 which allows the conductor to immediately extend away from the contact at an angle relative to the centerline axis 90. The lengths $L_1$ and $L_2$ could be varied to make the area 84 larger or smaller. The tip of the end 76 could also be turned forward if desired to at least partially close the open side 92 of the area 84. However, the side 92 is preferably kept open such that solder 54 can be poured into the area 84 through the open side 92.

As seen best in FIG. 3, when the end of the conductor 84 is positioned in the area 84 and solder 54 is placed into the area 84, the solder electrically and mechanically connects the conductor 48 to the contact 16. The conductor 48 extends away from the contact at an angle A to the centerline axis 90 at about 90°. The conductor can be bent such that, after the second housing member is over-molded onto the second connection section 52, the wire 46 can extend at an angle B relative to the axis 88 as shown in FIG. 1B. Thus, the wires 46 can extend away from the connector 10 at a compound angle; in the embodiment shown, in a plane transverse to the axis 90 and at angle B. As seen in FIG 1B, the wires 46 can extend out of the lateral side 94 of the second housing member 24 rather than the rear side 96. This provides a low profile connector and wire assembly which still allows the contacts to be formed from one-piece members and also allows the contacts to be formed with solder cups. However, in alternate embodiments, the wires 46 could extend out of any suitable side(s) of the second housing member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector and conductor assembly comprising:

a housing;

at least one contact connected to the housing, the contact having a formed one-piece member comprising a first connection section adapted to make a removable connection with a mating contact, and a second connection section having a receiving area adapted to have a conductor positioned in the receiving area; and a separate conductor connected to each contact at the second connection section of the contact(s), the conductor(s) extending away from the respective second connection section at a right angle to a longitudinal connection axis of the first section, wherein the housing comprises a first member having the first connection section of each contact located therein and a second member over-molded onto the first member and onto the second connection section of each contact.

2. An assembly as in claim 1 wherein the conductor(s) extend out of a lateral side of the over-molded second member.

3. An assembly as in claim 1 wherein the housing comprises mounting slots on opposite lateral sides.

4. An assembly as in claim 3 wherein the over-molded first member comprises an extension section with a rear side facing in a direction towards the second member, the extension section having a mounting projection extending from the rear side.

5. An electrical connector and conductor assembly comprising:

a housing;

at least one contact connected to the housing, the contact having a formed one piece member comprising a first connection section adapted to make a removable connection with a mating contact, and a second connection section forming a solder cup for receiving a conductor and solder to fixedly connect the conductor to the contact; and a separate conductor connected to each contact at the second connection section of the contact(s), the conductor(s) extending away from the respective second connection section at a right angle to a longitudinal connection axis of the first section, wherein the housing comprises a first member having the first connection section of each contact located therein and a second member over-molded onto the first member and onto the second connection section of each contact.

6. An assembly as in claim 5 wherein the conductor(s) extend out of a lateral side of the over-molded second member.

7. An assembly as in claim 5 wherein the over-molded second member comprises mounting slots on opposite lateral sides of the second member.

8. An assembly as in claim 5 wherein the first member comprises an extension section with a rear side facing in a direction towards the second member, the extension section having a mounting projection extending from the rear side.

* * * * *